United States Patent [19]

Maitan et al.

[11] Patent Number: 4,974,639

[45] Date of Patent: Dec. 4, 1990

[54] COMPENSATOR ROLL ARRANGEMENT IN A WARP LET-OFF

[75] Inventors: Giovanni Maitan, Vicenza; Luigi Corazzola, Tres; Enrico Fin, Vicenza; Giampietro F. Aggradi, Florence, all of Italy

[73] Assignee: Nuovopignone-Industrie Meccaniche E Fonderia S.p.A., Florence, Italy

[21] Appl. No.: 416,729

[22] Filed: Oct. 3, 1989

[30] Foreign Application Priority Data

Oct. 7, 1988 [IT] Italy ..... 22222 A/88

[51] Int. Cl.[5] ..... D03D 49/06

[52] U.S. Cl. ..... 139/109; 139/25

[58] Field of Search ..... 139/110, 109, 103, 102, 139/114, 115, 25, 100, 104, 105

[56] References Cited

U.S. PATENT DOCUMENTS

| | | | |
|---|---|---|---|
| 2,375,316 | 5/1945 | Moessinger | 139/110 |
| 4,262,706 | 4/1981 | Popp et al. | 139/110 X |
| 4,480,665 | 11/1984 | Imamuna et al. | 139/115 X |
| 4,564,050 | 1/1986 | Hirano | 139/109 X |

*Primary Examiner*—Andrew M. Falik

*Attorney, Agent, or Firm*—Morgan & Finnegan

[57] ABSTRACT

A warp yarn tensioning device for a loom, in which the warp yarns are wound about a compensator roller through an arc of approximately 180°. The roller is movable against the action of counteracting springs either by rotation or by translation in the direction of the thus wound substantially parallel warp yarns and is supported about an axis by bearings. The device operates in feeding the shed with yarns from the warp beam and in maintaining a constant yarn tension during loom operation. This is accomplished by supporting the compensator roll to undergo only a small amount of swing or translational movement in order to follow the warp yarn tension variations.

4 Claims, 4 Drawing Sheets

COMPENSATOR ROLL ARRANGEMENT IN A WARP LET-OFF

This invention relates to a new warp yarn tensioning device for a loom which, being of very low mass and requiring to undergo only minimum movements for compensation purposes and thus representing a system of minimum inertia and immediate response, is highly efficient and specifically suitable for the high operating speeds of modern looms, in particular terry cloth looms.

In looms the warp yarn tensioning device has the well known double purpose of feeding the shed with the yarns from the warp beam, and of maintaining an always constant yarn tension, particularly at the moment of formation of the terry in the case of terry cloth or on change-over of the heddle frames in the case of plain cloth.

In this respect, in the case of terry cloth weaving, when the reed beats the inserted weft yarns right down to form the terry, the tensioning device has to provide a length of warp yarn equal to the reed movement distance in order to keep the yarn tension constant and prevent the formation of terries having a height less that the scheduled height, resulting in a non-uniform terry cloth.

In the case of normal weaving, constant compensation is required for the variations in the warp length consequent on the opening of the shed.

In the current state of the art various types of tensioning devices for looms are known, all these known devices comprising substantially a series of deviation and return rollers for suitably guiding the warp yarns from the warp beam to the shed, plus a compensator roller about which the warp yarns wind, and which compensates said warp length variations by undergoing corresponding movement. This movement is generally provided by swinging the compensator roller about an external rotation shaft, to which the roller is connected by lateral support bars or walls, said swing being opposed by reaction springs.

To reduce the system inertia it has been sought to minimize the masses in play by constructing lightweight compensator rollers which, as they must also be rigid, have been supported in intermediate regions by intermediate support bars or walls, which are also as light as possible.

Notwithstanding this, all known devices have the drawback of requiring for compensation purposes a considerable movement to be undergone by the compensator roller, which because of the inevitable friction and inertia means that immediate response is not assured, with the consequent danger of producing defective products.

The objects of the present invention is to obviate said drawback by providing a warp yarn tensioning device for a loom, which has an immediate response and therefore requires the compensator roller to undergo only a small movement in order to exactly follow all warp yarn tension variations such as those due to the heddle frame movement or due to the final beating of the reed in the case of a terry cloth loom, so maintaining the warp yarn under permanently constant tension during weaving.

This is attained substantially in that the warp yarns are wound about the compensator roller through an arc of approximately 180°. In this manner any movement of the roller in the direction of the two substantially parallel branches of the warp yarn wound about it makes a length of warp yarn available which is twice the length of the movement or, in other words, a determined variation in warp yarn length is compensated by a movement of the compensator roller which is one half the extent of said length variation.

Thus, the device for tensioning the warp yarns between the warp beam and shed in a loom, comprising substantially a deviation roller, a reversing roller and a compensator roller which are positioned parallel to each other and about which said warp yarns wind, said compensator roller being free to rotate about its own axis and to move against the action of counteracting springs, is characterised according to the present invention in that said warp yarns are wound about said compensator roller through a winding arc of approximately 180° so that the movement of said compensator roller takes place in the direction of the two substantially parallel branches of the thus wound warp yarns, said compensator roller being the last element of the device before the shed, with reference to the warp yarn path.

According to a preferred embodiment of the present invention, said roller movement is obtained by the roller undergoing swing motion about an external shaft to which the roller is connected by lateral and intermediate support bars or walls which have openings to rotatably support said compensator roller and are opposed by said counteracting springs.

According to a further preferred embodiment of the present invention, said movement of the compensator roller is obtained by the roller undergoing translational motion against the action of a series of said counteracting springs positioned along its axis.

Finally, to obviate any possibility of the warp yarns sliding on the compensator roller which, by creating friction, would impede the rapid response of the device in addition to deteriorating the yarn, especially if delicate yarns are concerned, according to a further characteristic of the present invention said compensator roller is supported rotatable about its axis by means of bearings.

The invention is described in more detail herinafter with reference to the accompanying drawings, which illustrate a preferred embodiment thereof given by way of non-limiting example only, in that technical and constructional modifications can be made thereto but without leaving the scope of the present invention.

Figure 1:
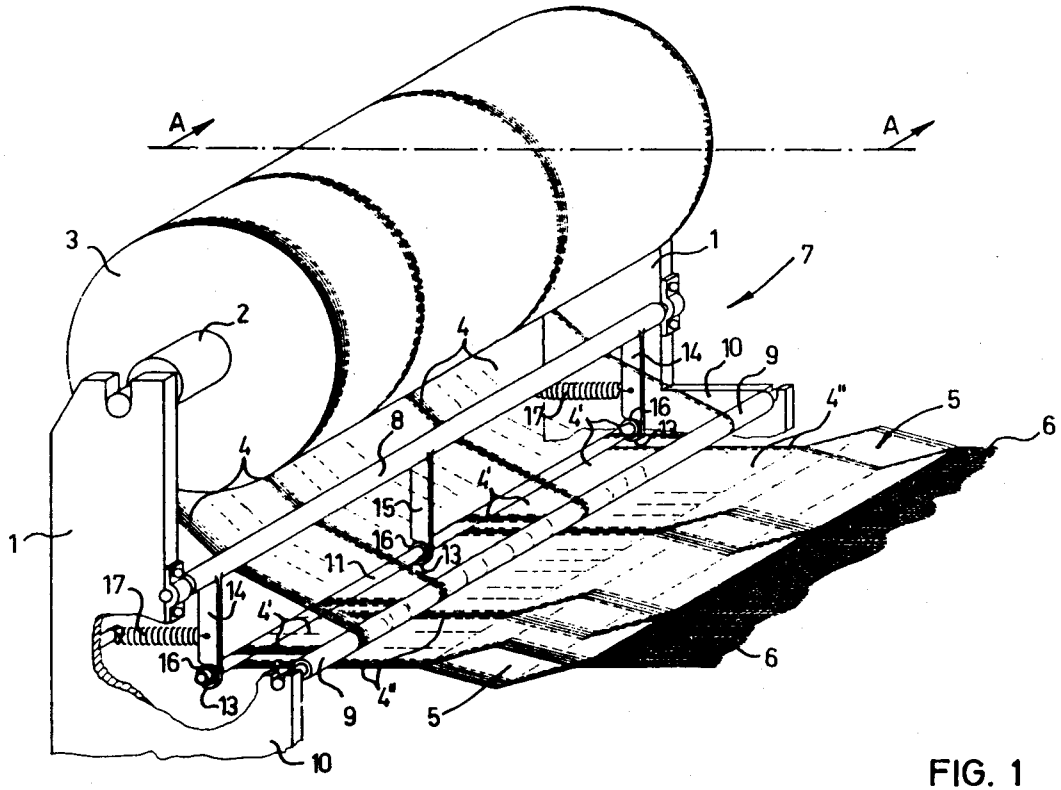
FIG. 1 is a partial perspective view of that part of a loom in which a warp yarn tensioning device constructed in accordance with the invention operates.

In the figures, 1 indicates the rigid loom structure which supports the shaft 2 of the warp beam 3 feeding the warp yarns 4 to the shed 5, and 6 indicates the formed cloth.

Said warp yarns 4 are kept under tension between the warp beam 3 and shed 5 by a tensioning device 7 comprising a deviation roller 8 which is supported rotatably by the rigid structure 1 and conveys the warp yarns 4 to a reversing roller 9 which is also supported rotatably by projecting shoulders 10 of the structure 1 and is positioned parallel to the deviation roller 8. Said reversing roller 9 is positioned such that the warp yarns 4' reversed by it wind about a compensator roller 11 through a winding arc 12 (see specifically FIGS. 2 and 3) of approximately 180° so that the two branches 4' and 4'' of the warp yarns are substantially parallel to each other.

Figure 2:
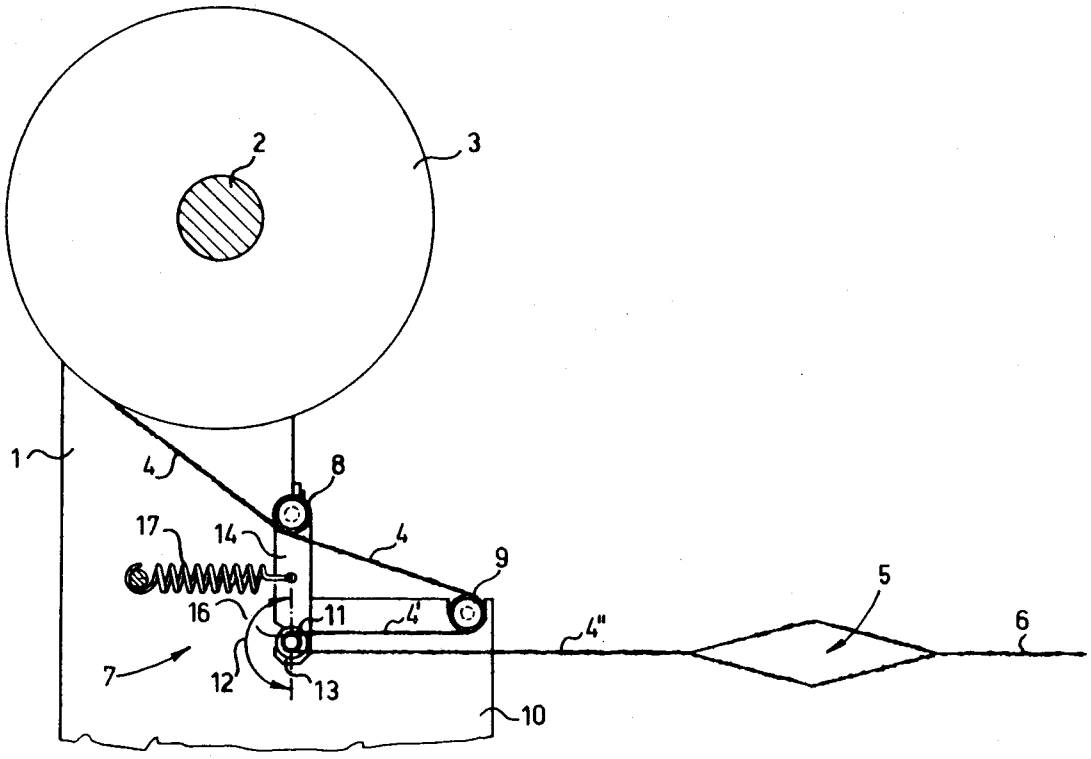
FIG. 2 is a side sectional view on the line AA of FIG. 1 to a different scale.
Figure 3:
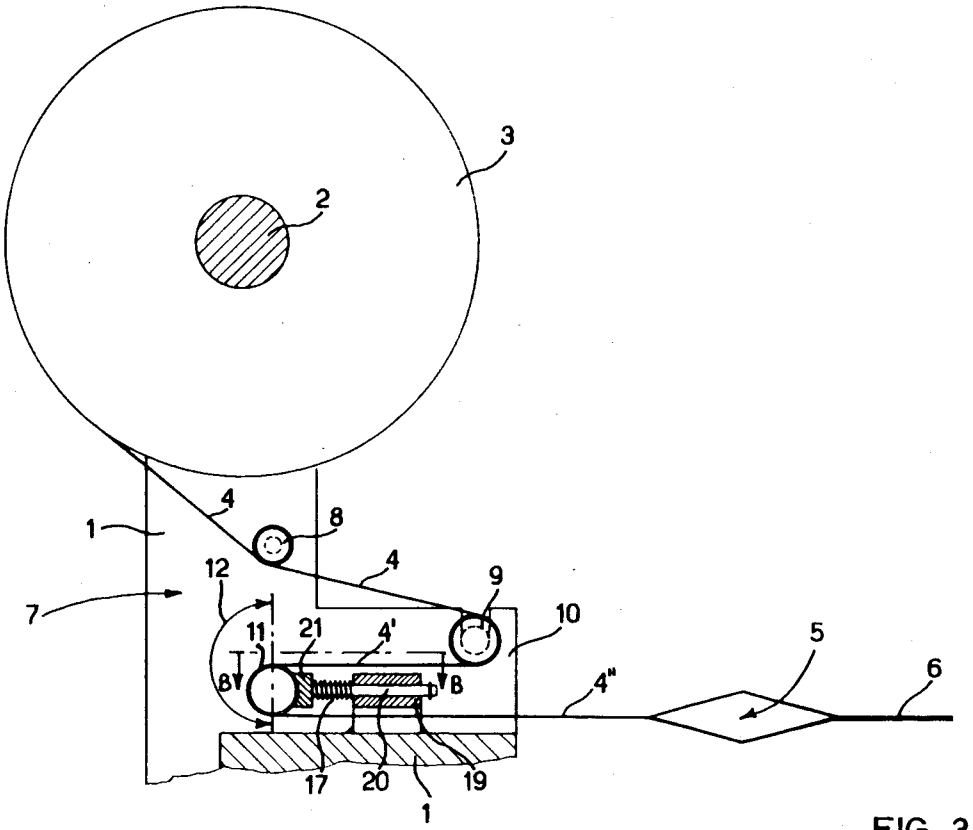
FIG. 3 is a side sectional view of a modification of the device according to the inventon.

Said compensator roller 1 is mounted rotatable about its axis in openings 13 provided in the free end of lateral support bars 14 and intermediate support bars 15 by way of rotation bearings 16. Said support bars 14 and 15 are hinged at their other end about an external rotation shaft which in FIGS. 1 and 2 is represented by the deviation roller 8 itself.

Figure 4:
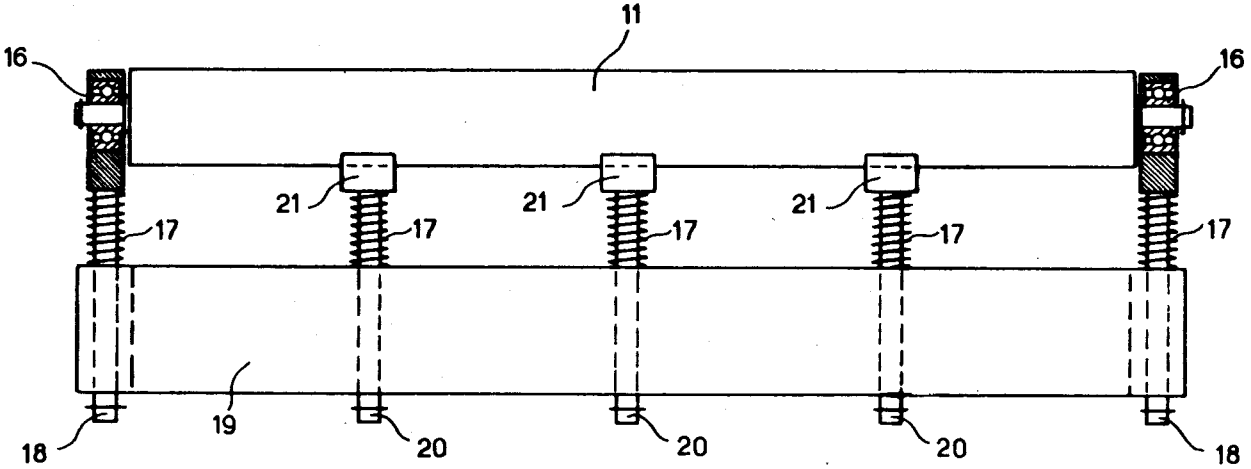
FIG. 4 is a plan view on the line BB of FIG. 3 to an enlarged scale, in which the warp yarns are omitted for clarity.

In this manner the compensator roller 11 can swing about the roller 8 against the action of counteracting springs 17, to compensate the variations in the length of the warp yarns during weaving and thus maintain the tension in said yarns constant. According to a modification of the invention (see FIGS. 3 and 4), the compensator roller 11 does not swing but instead is mounted to undergo translational movement in the direction of said substantially parallel branches 4' and 4'' of the warp yarns against the action of a series of counteracting springs 17 positioned along its axis. For this purpose said roller 11 is supported at its ends by two rotation bearings 16 which are translationally movable by push rods 18 which pass through a support block 19 rigid with the rigid loom structure 1 and are opposed by said counteracting springs 17. Similar spring-opposed push rods 20 support at their free end shoes 21 which provide intermediate support for said compensator roller 11 and are shaped to enable the roller 11 to rotate about its axis.

We claim:

1. A device for tensioning warp yarns between the warp beam and shed in a loom, comprising a deviation roller, a reversing roller and a compensator roller which are positioned parallel to each other and about which the warp yarns wind, the reversing and compensation rolls being arranged to cause the warp yarn wound therearound to form two parallel branches prior to forming a shed the compensator roller being rotatably supported and connected to an external shaft by lateral and intermediate support a bars or walls, the walls or bars having openings to rotatably support the compensator roller, said walls or bars being opposed by counteracting springs, the compensator roller being free to rotate about its own axis and to move against the action of counteracting springs, the movement of the compensator roller is obtained by the roller undergoing swing motion about the external shaft to which the roller is connected wherein the warp yarns are wound about the compensator roller through a winding arc of approximately 180° so that the movement of the compensator roller takes place in the direction of the two substantially parallel branches of the thus wound warp yarns, the compensator roller being the last element of the device before the shed, with reference to the warp yarn path.

2. A warp yarn tensioning device as claimed in claim 1, wherein the compensator roller is rotatably supported about its axis by means of bearings.

3. A device for tensioning warp yarns between the warp beam and shed in a loom, comprising a deviation roller, a reversing roller and a compensator roller which are positioned parallel to each other and about which the warp yarns wind, the reversing and compensation rolls being arranged to cause the warp yarn wound therearound to form two parallel branches prior to forming a shed the compensator roller being rotatably supported and mounted for translation movement against counteracting springs which are positioned along the axis of the compensator roller, the compensator roller being free to rotate about its axis and to move against the action of the counteracting springs, the movement of the compensator roller is obtained by the roller undergoing said translational motion against the action of the counteracting springs, wherein the warp yarns are wound about the compensator roller through a winding arc of approximately 180° so that the movement of said compensator roller takes place in the direction of the two substantially parallel branches of the thus wound warp yarns, the compensator roller being the last element of the device before the shed, with reference to the warp yarn path.

4. A warp tensioning device as claimed in claim 3, wherein the compensator roller is rotatably supported about its axis by means of bearings.

* * * * *